United States Patent [19]

Hearn

[11] Patent Number: 4,476,945

[45] Date of Patent: Oct. 16, 1984

[54] DRAINHOLD DRILLING

[75] Inventor: David D. Hearn, Richardson, Tex.

[73] Assignee: Atlantic Richfield Company, Los Angeles, Calif.

[21] Appl. No.: 465,407

[22] Filed: Feb. 10, 1983

[51] Int. Cl.[3] ..... E21B 19/22

[52] U.S. Cl. ..... 175/203; 175/220

[58] Field of Search ..... 175/61, 62, 202, 203, 175/103, 85, 162, 52, 220; 166/75 R, 50, 77, 77.5; 137/355.12, 355.16, 355.19, 355.26, 355.27

[56] References Cited

U.S. PATENT DOCUMENTS

| | | | |
|---|---|---|---|
| 2,271,005 | 1/1942 | Grebe | 175/61 |
| 2,548,616 | 4/1951 | Priestman et al. | 175/203 |
| 2,997,120 | 8/1961 | Kendrick | 175/103 |
| 3,116,781 | 1/1964 | Rugeley et al. | 166/77 |
| 3,179,187 | 4/1965 | Sarapuu | 175/62 |
| 3,370,656 | 2/1968 | Groler et al. | 175/103 |
| 3,702,223 | 11/1972 | Bednar | 175/103 |
| 3,841,407 | 10/1974 | Bozeman | 166/77 |
| 3,856,095 | 12/1974 | Adair et al. | 175/203 |
| 3,873,156 | 3/1975 | Jacoby | 175/61 |
| 3,884,528 | 5/1975 | Shaddock | 137/355.16 |
| 4,009,754 | 3/1977 | Cullen et al. | 166/77 |
| 4,154,310 | 5/1979 | Konstantinovsky | 175/103 |
| 4,317,492 | 2/1982 | Summers et al. | 175/61 |
| 4,333,539 | 6/1982 | Lyons et al. | 175/61 |
| 4,368,781 | 1/1983 | Anderson | 166/50 |

FOREIGN PATENT DOCUMENTS

| | | | |
|---|---|---|---|
| 996063 | 6/1965 | United Kingdom | 175/103 |

*Primary Examiner*—James A. Leppink
*Assistant Examiner*—Hoang C. Dang
*Attorney, Agent, or Firm*—Roderick W. MacDonald

[57] ABSTRACT

A method and apparatus for drilling and/or working in a drainhole wellbore which extends laterally from a primary wellbore which utilizes flexible hose which can be deployed into the primary wellbore and recovered from the primary wellbore in a coiled fashion, and uses apparatus for coiling, deploying and recovering the flexible hose which includes a rotatable drum operatively connected with a movable beam and guide means. The beam and guide means are utilized to position the flexible hose over the primary wellbore in such a manner that essentially only vertical external forces and essentially no lateral external forces are applied to the apparatus thereby eliminating the need to rigidly fix the apparatus to the earth or other support means when in use.

3 Claims, 9 Drawing Figures

DRAINHOLD DRILLING

BACKGROUND OF THE INVENTION

Heretofore, various types of deviated wellbores have been drilled from a primary wellbore. One particular type of deviated wellbore, known as a drainhole wellbore, is drilled from a primary wellbore through a sharp radius of curvature to extend laterally away from the primary wellbore. Normally, although not necessarily, the primary wellbore is essentially vertical and the drainhole, after passing through its sharp radius of curvature extends essentially horizontally away from the primary wellbore out into the producing geologic formation.

Heretofore, commercial drill pipe has been cut in such a fashion as to make it flexible and this drill pipe has been used to pass through the curvature of radius from the primary wellbore to the drainhole for drilling and/or other working in the drainhole. This type of flexible drill pipe is known in the drainhole wellbore art as "wigglies". Drainhole wellbores, the method for drilling same, and wigglies are fully and completely disclosed in U.S. Pat. Nos. 3,349,845 and 3,398,804.

BRIEF SUMMARY OF THE INVENTION

In drilling drainhole wellbores, since wiggly pipe sections have been used in drilling and otherwise working in drainhole wellbores, and since these wigglies are cut from sections of previously manufactured drilling tubing, the wigglies are limited to standard lengths (thirty feet) per wiggly. Thus, to increase the length of the drainhole, repeaated trips out of the hole with all of the drill pipe is necessary to add additional lengths of wigglies to the drill string. This is similar to conventional primary wellbore drilling. Consequently, it would be very helpful to have flexible, long length tubing for use in drilling and/or working in a drainhole wellbore which tubing is of substantially greater length than the conventional wiggly. For example, flexible hose could be made hundreds of feet long as compared to wigglies tens of feet in length thereby substantially reducing the number of trips out of the primary wellbore to add flexible drilling members to the drill string to extend the drainhole wellbore.

Accordingly, it is an object of the invention to provide new and improved method and apparatus for drilling drainhole wellbores.

Other aspects, objects and advantages of this invention will be apparent to those skilled in the art from this disclosure and the appended claims.

DETAILED DESCRIPTION OF THE INVENTION

Figure 1:
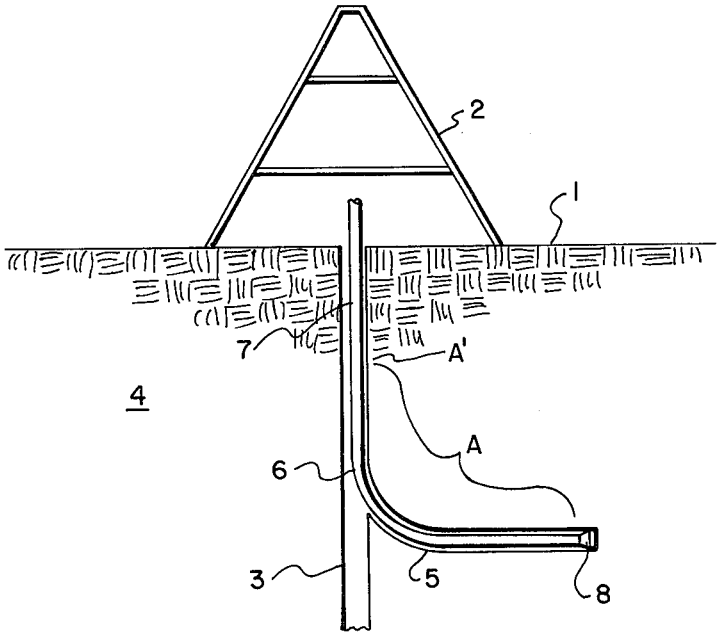
FIG. 1 (PRIOR ART)
FIG. 1 shows a cross-sectional view of the drilling operation for a conventional drainhole wellbore.

FIG. 1 shows the surface of the earth 1 with drilling rig (derrick) 2 set over primary wellbore 3 which extends essentially vertically downwardly into the earth 4. A lateral drainhole wellbore 5 is being drilled at essentially a right angle to primary wellbore 3 using flexible wigglies 6 to traverse the radius of curvature from vertical rigid drilling tubing 7 down to drill bit 8, the radius of curvature being denoted generally as A. Thus, the wigglies are used in the area A and when rigid drilling tubing 7 reaches the point A where it must start curving through radius of curvature A, drilling must stop, the entire drill string 6, 7 and 8, removed from primary wellbore 3, and another section of wiggly attached to tubing 7 to provide a greater length of flexible drill string to accomodate the ever-lengthening drainhole wellbore 5.

Figure 2:
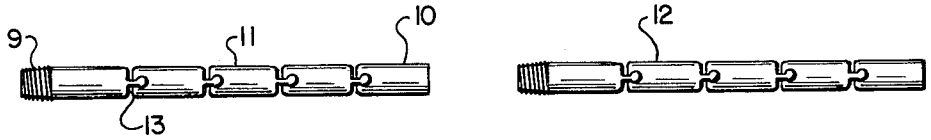
FIG. 2(PRIOR ART)
FIG. 2 shows two separate prior art wigglies.

FIG. 2 shows two sections of conventional wiggly tubing, each section having conventional pin 9 and box 10 connecting means so that one section of wiggly can be attached to the next section of wiggly in a conventional manner. Wigglies 11 and 12 of FIG. 2 were originally conventional rigid drilling tubing which has been cut at a plurality of places 13 so that the wigglies will bend at points 13 as more fully disclosed in the prior art patents cited hereinabove. As can be seen from FIG. 2, wigglies 11 and 12 are of a finite length, and, as can be seen from FIG. 3, the wall thickness of the wigglies is substantial so that the working interior opening 14 of the wigglies is rather restricted for procedures such as borehole logging and the like.

Figure 4:
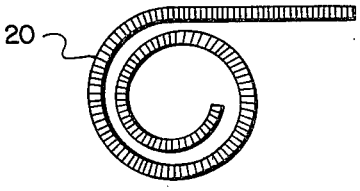
FIG. 4 shows a coil of flexible tubing without its supportive drum or other associated apparatus.

FIG. 4 shows a coil of flexible metal hose which can be wound into a relatively small area so that a substantial length of hose can be stored, transported and the like without taking up an unduly large volume, but yet still provide a substantial length of flexible drilling tubing for use in the manner shown for wigglies 6 in FIG. 1. For example, whereas, each individual wiggly 11 and 12 in FIG. 2 might cover a length of thirty feet in area A of FIG. 1, a single coil of hose 20 can be made 200 or more feet long so that a substantial continuous flexible member can be employed in primary wellbore 3 and in drainhole 5 with all the obvious operational advantages therefor such as reducing the number of trips out of the hole with the drill string.

Figure 3:
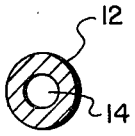
FIG. 3 (PRIOR ART)
FIG. 3 shows a cross-section of one of the wigglies of FIG. 2.
Figure 5:
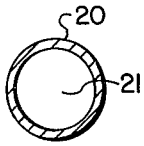
FIG. 5 shows a cross-section of the tubing of FIG. 4.

FIG. 5 shows a cross-section of flexible hose 20 and demonstrates that the wall thickness of the specially made flexible hose is substantially thinner than that of the prior art tubing of FIG. 3 thereby leaving a much larger interior working volume 21. This will facilitate logging and other wellbore working practices normally carried out through drilling or workover tubing.

Figure 6:
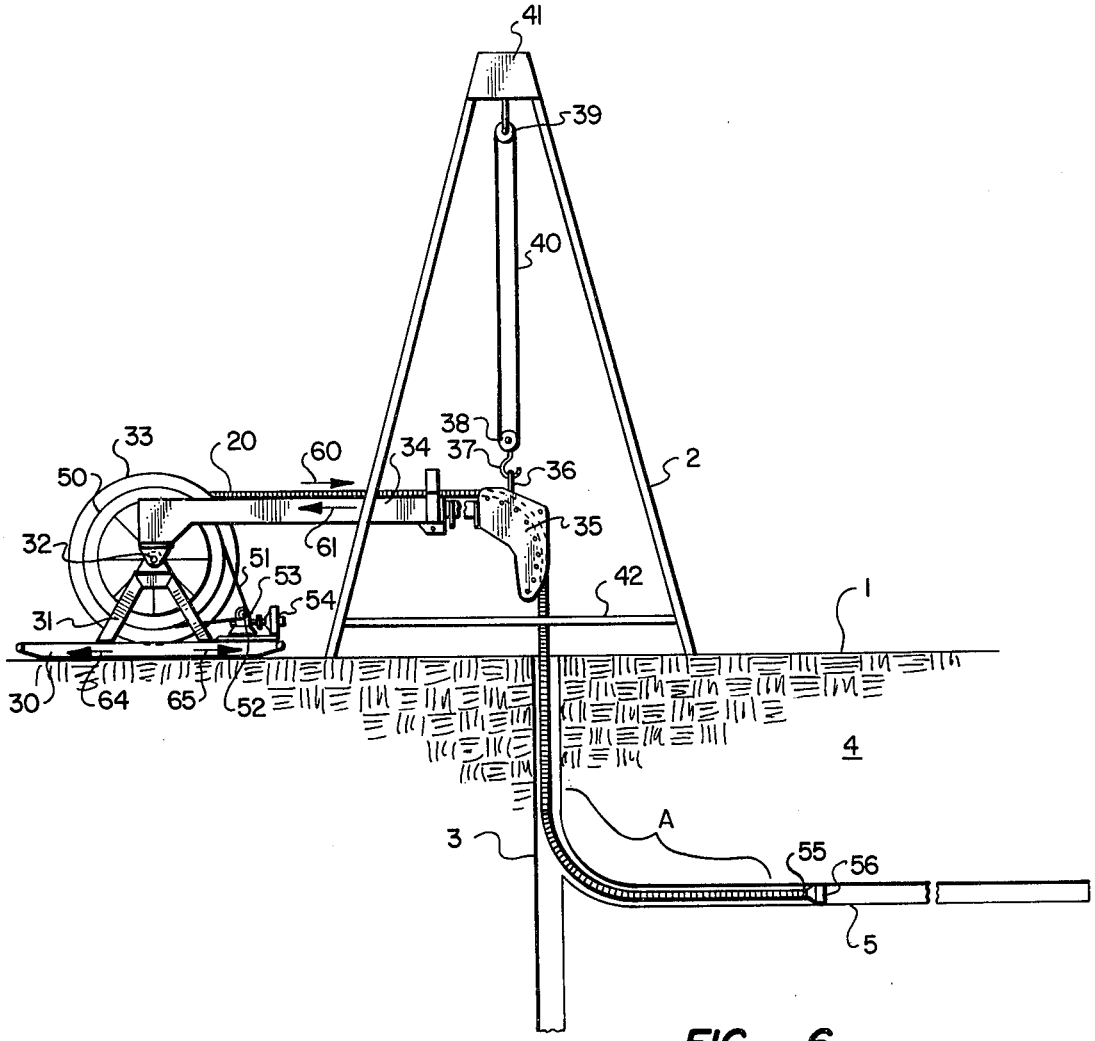
FIG. 6 shows a cross-section of a primary wellbore and drainhole wellbore while coiled flexible tubing is being employed into those wellbores in accordance with this invention.

FIG. 6 shows the earth's surface 1 with derrick 2 over primary wellbore 3 and drainhole wellbore 5 extending essentially at a 90° angle with primary wellbore 3. However, in this embodiment of this invention, flexible hose 20 is employed into primary wellbore 3 and drainhole 5 by means of apparatus which comprises a base means 30 with upstanding support means 31 that rotatably carries at pivot 32 a drum 33. Drum 33 holds hose 20 in a coiled manner as shown in FIG. 4. Also fixed at pivot 32 and supported by member 31 is a rigid beam 34 which has guide means 35 fixed at its opposite end from pivot 32. Guide means 35 carries any suitable member 36 for receiving a hook or other support means 37 so that beam 34 and guide means 35 can be supported by derrick 2 as shown in FIG. 6. Blocks 38 and 39 have threaded thereabout wire cable 40, block 39 being supported from crown block 41 of derrick 2. Derrick 2 also has a working floor 42 with a hole therein situated over primary wellbore 3 so that material can be fed from working floor 42 through the floor hole and into wellbore 3. Numerous other apparatus will be employed on working floor 42 in conjunction with drilling or well workover activities but are not shown here or in FIG. 1 for sake of simplicity. Such apparatus would be readily known to one skilled in the art and, therefore, its disclosure here is not necessary to inform those skilled in the art.

Drum 3 is rotatably supported at pivot 32 so that hose 20 can be fed into wellbore 3 or recovered from wellbore 3 directly from or to its coiled position on drum 33. In the situation of FIG. 6, it is shown that hose 20 extends from drum 33 all the way into drainhole 5 again only for sake of simplicity. In actuality, as would be obvious to those skilled in the art, all of the flexible hose 20 would be hanging vertically in Primary wellbore 3 with inflexible rigid drill tubing extending from the earth's surface down to and connected to the upper end of hose 20 before the lower end of hose 20 ever reaches drainhole 5. This is so because in a large majority of well situations, drainhole 5 will be thousands of feet below earth's surface 1 whereas less than a thousand feet of flexible hose 20 will be employed at any given time in the drilling and/or other working of drainhole 5.

In the embodiment of FIG. 6, drum 33 has fixed thereto a large gear means 50 which is connected by drive chain 51 to a small gear means 52 which is rotatably carried by gear box 53. Gear box 53 is driven by motor 54. The driving force for motor 54 and, therefore, the turning force for drum 33 for feeding out or recovering hose 20 can be any desirable means be it diesel driven, gasoline driven, electric, hydraulic, pneumatic, or the like.

Hose 20 can be fitted at its lower end 55 with any desirable working tool 56. For example, end 55 can carry a drill bit 8 (FIG. 1) for initially drilling or lengthening drainhole 5 or it can carry a pack off or other working tool normally employed in a wellbore for working operations that are carried out in an already drilled wellbore. Such operations include logging, fracturing, cementing, acidizing, and the like. When hose 20 is employed in a working manner in drainhole 5, the upper end of hose 20 will be situated somewhere in primary wellbore 3 above drainhole 5 as shown for wigglies in FIG. 1, and this upper end of hose 20 will be connected in a conventional manner with inflexible, rigid drilling tubing or other steel pipe in a conventional manner as shown for pipe 7 of FIG. 1. However, because hose 20 can be employed in single continuous lengths of hundreds of feet, less trips out of primary wellbore 3 will be necessary in order to drill a long drainhole 5 or to reach the end of a long drainhole 5, both with fewer trips out of primary wellbore 3 to add shorter finite lengths of wigglies as shown in FIG. 2. This substantially enhances the efficiency of drilling and otherwise working in drainhole wellbores especially when drainhole wellbores extends hundreds of feet away from primary wellbore 3.

Other drilling and work-over efficiencies are achieved by this invention by employing the equipment shown in FIG. 6 because this equipment is designed so that when supported by derrick 2 as shown in FIG. 6, the tension force 60 in hose 20, when the hose is being employed into wellbore 3 or being recovered from that wellbore, is matched by the compressive force 61 in rigid beam 34. This way only vertical external forces are applied to hose 20, guide means 35, and beam 34 and these external forces are accommodated by the hook 37, cable 40, etc. which is supported by derrick 2. The final result then is that essentially no lateral external forces are applied to base means 30 of the apparatus. This eliminates any need to rigidly fix in a substantial manner base means 30 to earth 4 or any other support means that base means 30 may be resting upon when the apparatus is in use. That is to say, that base means 30 is not subjected to forces in the direction shown by either of arrows 64 and 65. Thus, the hose and its associated apparatus as shown in FIG. 6 can be merely set on the ground adjacent derrick 2 so that beam 34 extends over working floor 42 and guide means 35 is located over the hole in floor 42 and directs hose 20 directly down into wellbore 3 and recovers hose 20 from wellbore 3 in the same direct manner. Beam 34 directs the travel of hose 20 to or from drum 33 along that beam (either above the beam as shown in FIG. 6 or inside or below the beam as desired by the particular design engineer).

Figure 7:
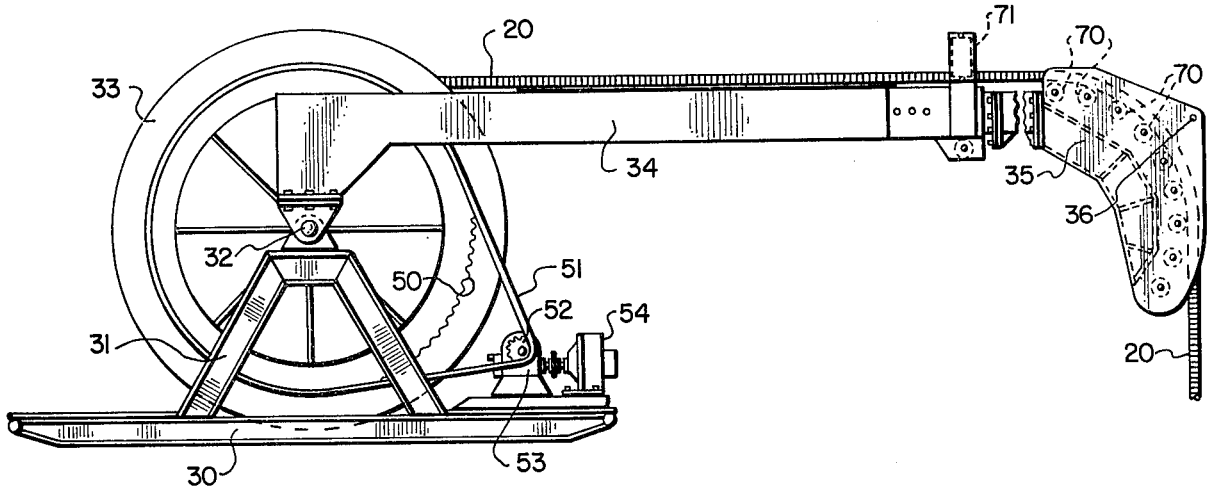
FIG. 7 shows a side view of apparatus for employing and recovering in a coiled manner flexible hose to be used in drainhole drilling and/or working.

FIG. 7 shows the apparatus of FIG. 6 in greater detail and in particular, shows that axle 32 supports drum 33 in a rotatable manner and at the same time, supports beam 34 in a pivotal manner so that guide 35 can be raised or lowered for proper direction of hose 20 into or out of wellbore 3. Although many suitable guide means can be designed by those skilled in the art once apprised of the goals and advantages of this invention, guide means 35 is shown in FIG. 7 to contain a plurality of rollers 70 which are used to translate hose 20 from a vertical to a horizontal orientation or vice-versa. Additional upstanding guide means 71 are employed to keep hose 20 aligned along the top of beam 30 as it passes to or from drum 33. Although a chain drive is shown for FIG. 7, any other obvious means for connecting a power means such as motor 54 to drum 33 for rotation of drum 33 in either the clockwise or counter-clockwise direction, as viewed in FIG. 7, is within the scope of this invention as is any form of motivating power for motor 54. Similarly, rigid beam 34 can be made extensible by telescoping or addition of one or more rigid segments to the beam between the end thereof and guide means 35 and the like as desired and obvious to those skilled in the art.

Figure 8:
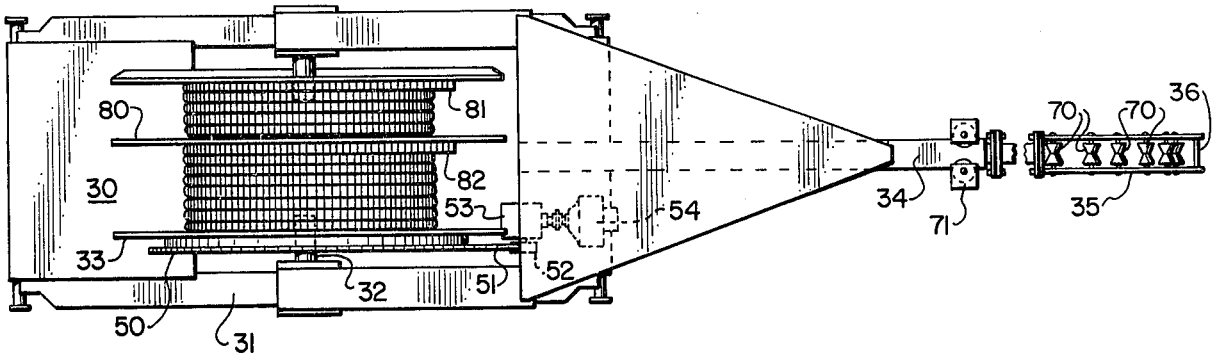
FIG. 8 is a top view of the apparatus of FIG. 7.

FIG. 8 shows the apparatus of FIG. 7 with a modification in that drum 33 carries a divider means 80 so that two separate flexible hoses 81 and 82 can be carried on the same drum means 33 at the same time and each be instantly accessed by the operator of the apparatus. This side-by-side supporting of more than one flexible hose by single drum 33 is desirable in case additional hose becomes necessary, or for flexibility in operations in that hoses 81 and 82 need not necessarily be of the same length. For example, hose 81 could be 200 feet in length and hose 82 400 feet in length so that in a situation where no more than 200 feet of hose is necessary, hose 81 is immediately accessible and hose 82 need not be used at all. Similarly, in situations where 600 feet of hose may be necessary, the two hoses can be connected together to meet a 600 foot drainhole drilling or workover requirement. Also, a pawl means can be employed in an obvious manner to move either or both of hoses 81 or 82 into a proper position for uniform recoiling of the hoses as they are removed from the wellbore.

Figure 9:
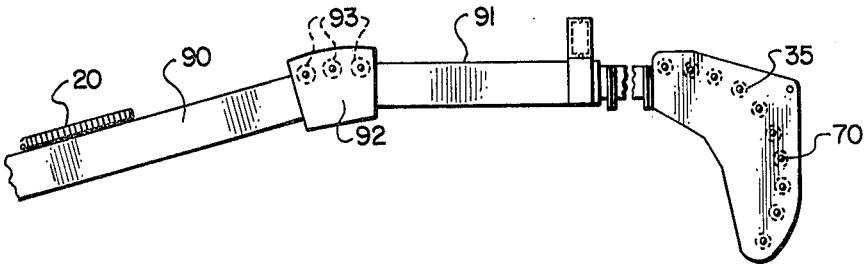
FIG. 9 is a side view of a modification of the apparatus of FIG. 7.

FIG. 9 shows a modification of the apparatus of FIG. 7 in which rigid beam 34 is broken into two separate rigid segments 90 and 91 which are joined together by an arcuate guide means 92 that is similar to guide means 35 with its rollers 70. Guide means 92 also contains an arcuately disposed plurality of rollers 93 which are used to guide hose 20 from the angle of inclination of member 90 to the angle of inclination of member 91 and back again. By the use of one or more guide means 92, a greater height for guide means 35 over working floor 42 can be achieved if necessary and not achievable by the apparatus shown in FIG. 7. Other mechanical variations of the apparatus disclosed hereinabove to achieve the desired results of this invention will be obvious to those skilled in the art and are included within the scope of this invention.

Reasonable variations and modifications are possible within the scope of this disclosure without departing from the spirit and scope of this invention.

I claim:

1. Apparatus for employing a coiled hose into a primary wellbore and for recovering said hose from said wellbore in a coiled manner comprising a base means, a support means carried by said base means, a drum means for carrying said hose in a coiled manner, said drum means being rotatably supported by said support means, a rigid beam pivotally carried by said support means and extending away from said drum means so that said hose passes to or from said drum means along said beam, a guide means fixed to the end of said beam furthest from said drum means for guiding said hose from said furthest end of said beam down into said primary wellbore or out of said primary wellbore up to said beam, said hose when being employed or received being under tension and said beam supporting said hose being under compression, at least one of said beam and guide means carrying means adapted to be supported by a well drilling derrick so that when employing or receiving said hose the tension force in said hose is essentially matched by the compression force in said beam and essentially only vertical external forces are applied to said apparatus with the result that essentially no lateral external forces are applied to said base means thereby eliminating the need to rigidly fix said base means to the earth or other support means when said apparatus is in use.

2. The apparatus of claim 1 wherein said drum means is adapted to hold a plurality of hoses thereon at the same time and in a side-by-side relationship.

3. The apparatus of claim 1 in combination with a well derrick which includes a working floor with a hole therein situated over said primary wellbore and in said combination said base means sits adjacent said working floor, said beam extends over said working floor, and said guide means is positioned over said hole so that the hose on said guide means is aligned with said primary wellbore while said hose enters or leaves said primary wellbore.

* * * * *